United States Patent [19]

Cason

[11] Patent Number: 4,586,686

[45] Date of Patent: May 6, 1986

[54] SPRING ACTIVATED CAM ANCHOR

[76] Inventor: David A. Cason, Box 297 R.R. 4, Kingston, N.Y. 12401

[21] Appl. No.: 670,989

[22] Filed: Nov. 13, 1984

[51] Int. Cl.[4] ..... B66D 1/54

[52] U.S. Cl. ..... 248/1

[58] Field of Search ..... 248/1; 254/104; 294/94, 294/116; 52/160, 162; 411/21, 22, 340–346; 24/606–608, 453

[56] References Cited

U.S. PATENT DOCUMENTS

| | | | |
|---|---|---|---|
| 977,795 | 12/1910 | Gronke | 411/345 |
| 1,035,419 | 8/1912 | Clark | 411/344 |
| 1,133,947 | 3/1915 | Fischer | 411/344 |
| 1,175,824 | 3/1916 | Roznowski | 411/344 |
| 1,199,297 | 9/1916 | Obeda | 411/344 |
| 3,877,679 | 4/1975 | Lowe | 248/1 |
| 4,184,657 | 1/1980 | Jardine | 248/1 |
| 4,491,291 | 1/1985 | Ching | 248/1 |

FOREIGN PATENT DOCUMENTS

| | | | |
|---|---|---|---|
| 1092415 | 11/1960 | Fed. Rep. of Germany | 411/21 |

*Primary Examiner*—J. Franklin Foss
*Assistant Examiner*—Robert A. Olson
*Attorney, Agent, or Firm*—Shlesinger, Arkwright, Garvey & Fado

[57] ABSTRACT

A spring activated cam anchor has a frame with a forward end and a rearward end and a pair of spaced apart legs that extend from the forward end and each of the legs has a substantially planar upper and lower surface. A shaft is disposed between the legs and a first and second cam are rotatably mounted to the shaft and adapted for rotating in a common direction between an insert position and a withdrawal position. Each of the cams has an engagement portion extending outwardly beyond the upper surface when in the insert position and disposed between the surfaces when in the withdrawal position. A lever actuated assembly is connected to each of the cams for rotating the cams between the insert position and the withdrawal position. The cams further include a lost motion system permitting the cams to independently rotate between the insert position and the withdrawal position when the chockstone is inserted into a fissure in a rock face.

20 Claims, 6 Drawing Figures

SPRING ACTIVATED CAM ANCHOR

BACKGROUND OF THE INVENTION

An artificial chockstone is inserted into an exposed fissure in a rock face in order to facilitate the climbing of the rock face. The chockstone normally includes a loop hanging therefrom for receiving therein a length of rope which secures two or more climbers together. It is usual practice to utilize a rope, secured in slidable manner to the face being climbed, in order to prevent the fall of all climbers should one climber slip.

Numerous chockstones are utilized during the climbing of a rock face. The chockstones must be lightweight, therefore, in order that they may be carried by the climbers, particularly by the lead climber. The chockstones must be easily and quickly insertable into the fissures in order to not delay the climbers. Naturally, the chockstones, when inserted, must securely grasp the walls of the fissure in order to perform the intended function.

The chockstones must be quickly and easily removable in order to not delay the climbers during the ascent or descent. Removability of the chockstones is required in order to prevent permanent scarring of the rock face after numerous climbs. Removability of the chockstones prevents the rock face from becoming cluttered with chockstones.

Jardine, U.S. Pat. No. 4,184,657, discloses a climbing aid wherein two pair of cam members are connected to a support bar. The cam members are spring-loaded and cooperate with an operating bar for being displaced between an open and a closed position. Jardine discloses connecting each of the cams to the operating bar by means of wire sections. It can be seen that the climbing aid of Jardine must first be configured for being inserted into the fissure. Secondly, the operating bar must then be released in order to permit the cams to swing outwardly in order to engage the walls of the rock face. Removal of the climbing aid is equally complicated. Consequently, insertion and removable of the climbing aid of Jardine is rendered difficult because of the necessity of orienting the cam members by means of the operating bar.

Lowe, U.S. Pat. No. 3,877,679, discloses an anchor device for mountain climbers wherein a main body is pivotably connected to an orientation assembly. The main body is spring-loaded whereby the main body is urged into a cam position. Insertion of the anchor device requires that the main body be properly oriented prior to insertion in the fissure. Removal of the chockstone is complicated by the need to properly orient the main body prior to removal. In fact, removal of the Lowe chockstone, as well as the other prior art chockstones, may be difficult, if not impossible, if improperly inserted.

The disclosed invention provides a unique artificial chockstone or spring activated cam anchor which is easily and quickly inserted and secured into a fissure in the rock face. The cams are spring-loaded such that an engagement surface of the cam extends outwardly beyond the upper surface of the frame to which the cams are pivotably connected. A linkage mechanism interconnects the cams with an actuation assembly and the cams are free to independently pivot from an insertion position to a withdrawal position. Each of the cams has an arcuate slot which receives a pin of the actuation assembly and which permits independent rotation of the cams so that the chockstone may be inserted into a fissure having an irregular surface without the need to orient the cams prior to insertion. Removal of the chockstone is easily accomplished through utilization of the levered actuation mechanism which rotates the cams from the insertion position.

OBJECTS AND SUMMARY OF THE INVENTION

The primary object of the disclosed invention is to provide a spring-loaded cam anchor or chockstone which is quickly and easily insertable into a fissure and which is quickly and easily removable therefrom.

An additional object of the disclosed invention is to provide spring-loading for the cams in order to urge the cams into the insertion position and thereby eliminate the need to orient the cams prior to insertion.

Yet an additional object of the disclosed invention is to permit independent rotation of the cams from the insertion position to the withdrawal position in order to facilitate insertion of the chockstone into a fissure having an irregular surface.

Yet another object of the disclosed invention is to provide a lever actuated assembly for causing simultaneous rotation of the cams in the same direction.

Still yet a further object of the disclosed invention is to provide an artificial chockstone which is lightweight and which is easily assembled from a relatively few number of parts.

A further object is to provide a chockstone body of substantial width so that the loop of rope will be open at all times to facilitate attachment to a clamp or climbing rope.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figures 1, 2:
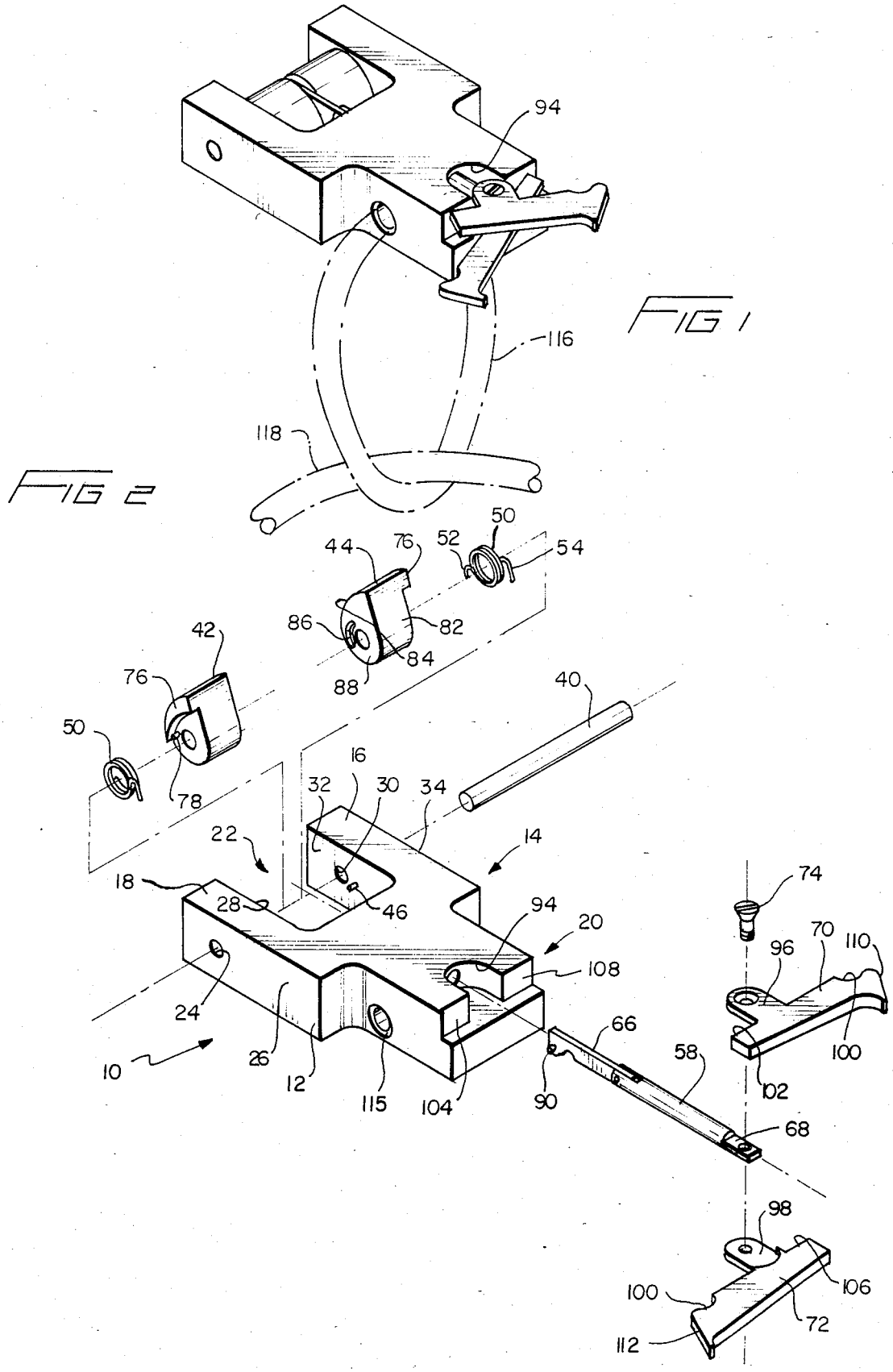
FIG. 1 is a perspective view of the chockstone of the invention in the withdrawal position.
FIG. 2 is an exploded assembly drawing of the invention.

As best shown in FIG. 2, artificial chockstone or spring activated cam anchor 10 has a generally U-shaped body 12, preferably comprised of aluminum. Body 12 has a forward portion 14 from which spaced parallel legs 16 and 18 longitudinally extend. Rearward portion 20 extends longitudinally rearwardly from forward portion 14. It can be noted in FIG. 2 that rearward portion 20 has a width less than the width of forward portion 14 and the width of rearward portion 20 is substantially equal to the space 22 between the inner surfaces of parallel legs 16 and 18.

Figure 3:
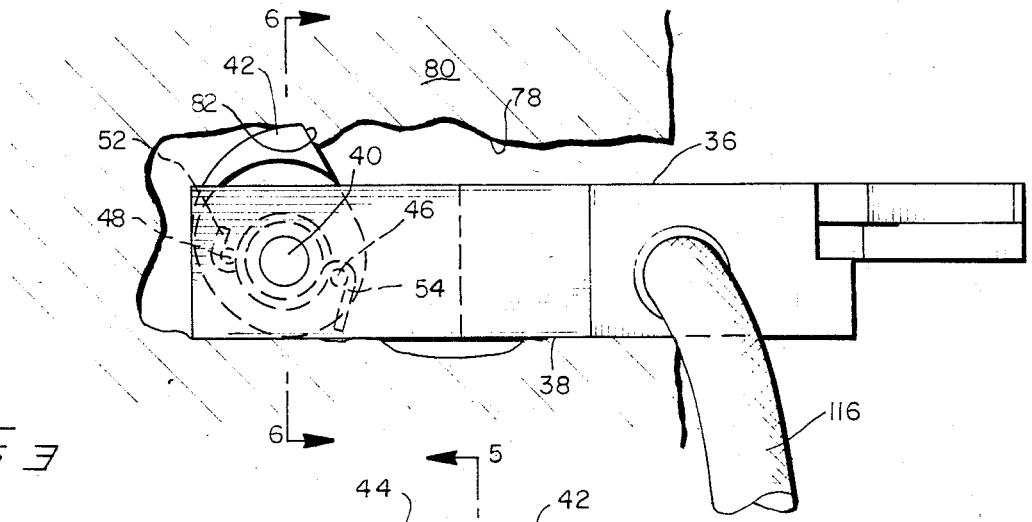
FIG. 3 is a side elevational view of the invention inserted into a fissure.

Aperture 24 is disposed in leg 18 and extends from the outer surface 26 thereof to the inner surface 28. Leg 16 has an aperture 30 coaxially aligned with aperture 24 of leg 18. Aperture 30 extends from inner surface 32 to outer surface 34. Body or frame 12 has a substantially planar upper surface 36 which is parallel to substantially planar lower surface 38, as best shown in FIG. 3. Surfaces 36 and 38 extend the length of legs 16 and 18 and thereby the legs 16 and 18 have aligned upper and lower parallel surfaces.

Figure 4:
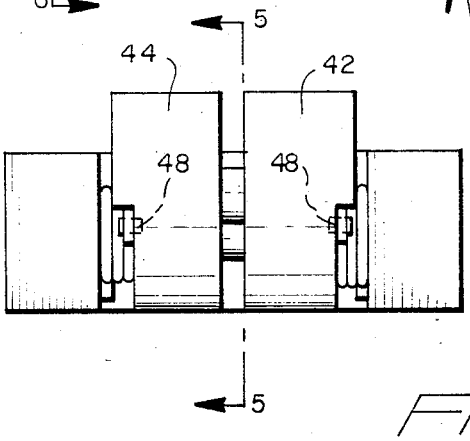
FIG. 4 is a front elevational view.
Figure 6:
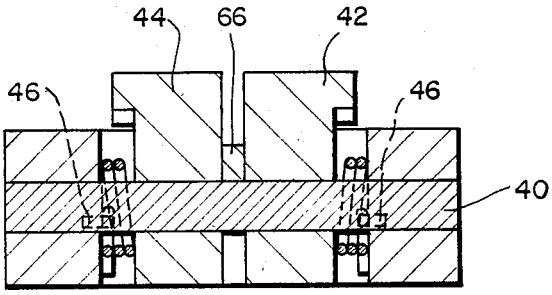

Shaft 40 is received in apertures 24 and 30 and extends between the legs 16 and 18. Cams 42 and 44 are rotatably mounted to shaft 40 and are disposed in side by side relation and each of the cams 42 and 44 is adjacent one of the legs 16 and 18. As best shown in FIGS. 2 and 6, spring retainers 46 extend inwardly from each of legs 16 and 18. Cams 42 and 44, as best shown in FIG. 4, each have spring retainers 48 extending outwardly therefrom. Coils springs 50 have a first hooked end 52 and a second hooked end 54. First end 52 engages with retainers 48 while second end 54 engages retainers 46. In this way, the action of the coil springs 50 urges the cams 42 and 44 to rotate. The action of the springs 50 places the cams 42 and 44 under load when not in the insertion position. This spring-loading facilitates insertion and securement of chockstone 10.

Figure 5:
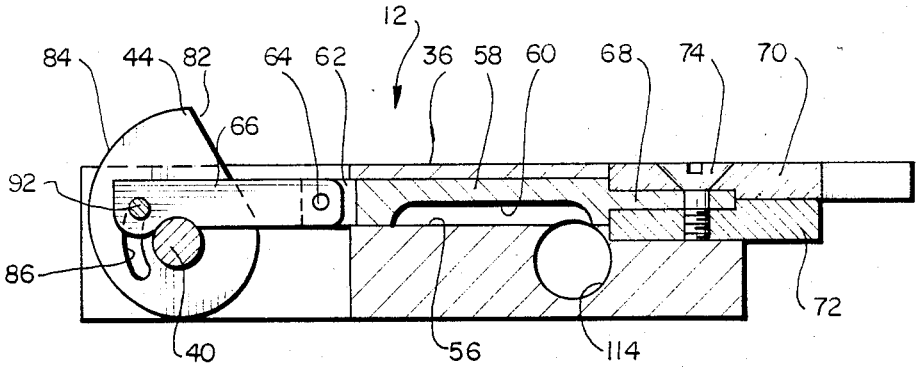
FIG. 5 is a cross-sectional view taken along the section 5—5 of FIG. 4 and viewed in the direction of the arrows; and, FIG. 6 is a cross-sectional view taken along the section 6—6 of FIG. 3 and viewed in the direction of the arrows.

As best shown in FIG. 5, body or frame 12 includes a centrally disposed aperture 56 extending between forward portion 14 and rearward portion 20. Central shaft 58 is slidably received in aperture 56. It can be noted in FIG. 5 that central shaft 58 includes a recess 60, for reasons to be explained further. Central shaft 58 has a forward end 62 which is hingedly connected by pin 64 to forward member 66. Rearward portion 68 is hingedly connected to levers 70 and 72 by bolt, or other connection means, 74.

As best shown in FIGS. 2 and 5, each of cams 42 and 44 includes an outwardly extending arcuate flange portion 76 which protects the associated coil spring 50 when the chockstone 10 is inserted into a fissure, such as fissure 78 of rock face 80 of FIG. 3. Cams 42 and 44 each include a substantially flat peripheral engagement surface or portion 82 and an arcuate peripheral surface or portion 84. It can be noted in FIG. 5 that the engagement portion 82, when in the insertion position, extends angularly upwardly beyond upper surface 36 while the engagement portion 82 is disposed between surfaces 36 and 38, when in the withdrawal positon, as shown in FIG. 1.

Each of cams 42 and 44 includes an arcuate slot 86 extending along the inner surface 88 thereof. Forward member 66 includes outwardly extending pins 90 and 92, as best shown in FIGS. 2 and 5, respectively. Forward member 66 is adjacently disposed to the inner surface 88 of each of cams 42 and 44. Pin 90 is slidably received in slot 86 of cam 42 while pin 92 is slidably received in slot 86 of cam 44. In this way, the cams 42 and 44 are interconnected. The arcuate slots 86, however, permit the cams 42 and 44 to independently rotate forwardly toward rearward portion 20 in the event that one or both of the cams 42 and 44 should have its arcuate peripheral portion 84 engaged with an irregular surface of fissure 78. The independent rotational movement of the cams 42 and 44 permits the chockstone 10 to be inserted into fissure 78 having an irregular upper surface because the cams 42 and 44 may strike the surface and individually rotate rearwardly in order to clear the surface. This permits the chockstone 10 to be inserted fully into the fissure 78.

It can be noted in FIG. 5 that the aperture 56 has a substantial portion thereof disposed above shaft 40. Likewise, pins 90 and 92 are disposed above shaft 40 with the result that the arcuate surface 84 is eccentrically rotated on shaft 40 so that the surface 84 is either flush with top surface 36 or barely extends above top surface 36 when the cams 42 and 44 are in the withdrawal position. In this way, the chockstone 10 may be inserted into a fissure 78 having a width or height which is not substantially more than the thickness of body 12, as defined by the surfaces 36 and 38.

As best shown in FIG. 2, rearward portion 20 includes arcuate forwardly extending recess 94. Lever 70 includes arcuate portion 96 while lever 72 includes corresponding arcuate portion 98. The portions 96 and 98 are positioned within recess 94 when the chockstone 10 is in the insertion position, such as in FIG. 5. The arcuate portions 96 and 98 are movable from the recess 94 when the chockstone 10 is in the withdrawal position, as best shown in FIG. 1.

Each of the levers 70 and 72 includes a notch 100 in order to facilitate grasping by the user (not shown). Lever 70 includes a cam portion 102 which engages rear surface 104 of rearward portion 20. Similarly, lever 72 includes cam portion 106 which engages rear surface 108 of rearward portion 20. Lever 70 includes terminal portion 110 which is spaced from cam portion 102 while lever 72 includes terminal portion 112 which is spaced from cam portion 106. Grasping of the notches 100 and urging of the terminal portions 110 and 112 together causes the camming portions 102 and 106, respectively, to bear against their associated bearing surfaces 104 and 108, respectively, with the result that the shaft 58 is drawn rearwardly and thereby causes the cams 42 and 44 to rotate from the insertion position to the withdrawal position. The scissors action of the levers 70 and 72 greatly facilitates removal of the chockstone 10 from the fissure 78. The scissors action of the levers 70 and 72 permits the cams 42 and 44 to quickly and easily rotate the engagement portions 82 out of engagement with the upper surface of the fissure 78 in order to effectuate removal of the chockstone.

As best shown in FIGS. 3 and 5, opening 114 extends through rearward portion 20 and has champfered ends 115. Loop 116 passes through opening 114 and is maintained open due to the width of rearward portion 20 in order to facilitate receipt of climbing rope 118 or connection to a clamp. It can be noted in FIG. 5 that opening 114 has a portion thereof aligned with aperture 56. The recess 60 in central shaft 58, however, is disposed above the opening 114, and the loop 116, and thereby prevents the loop 116 from becoming damaged or frayed by the action of the central shaft 58. Similarly, ends 115 prevent loop 116 from fraying. Preferably, climbing rope 118, as best shown in FIG. 1, is received within loop 116 and thereby the climbers (not shown) are connected to the chockstone 10.

OPERATION

Use of the chockstone 10 is simple and efficient, whether being inserted into the fissure 78 or withdrawn therefrom. The chockstone 10 is merely inserted into the fissure 78 with the cams 42 and 44 in the insert position; that is, the engagement portions 82 thereof extending angularly upwardly beyond upper surface 36. The chockstone 10 is inserted into the fissure 78 until such time as the engagement portions 82 of the cams 42 and 44 engage with and are secured by a portion of the surface thereof. A rearwardly directed force applied to the chockstone 10 causes the cams 42 and 44 to resist removal because the lower surface 38 of the body 12 bears against the lower surface of the fissure 78. Consequently, the chockstone 10 is secured in the fissure 78 and removal is all but impossible without utilization of the levers 72 and 70, as will further described.

Removal of the chockstone 10 from the fissure 78 can be quickly and selectively accomplished by exerting a forwardly directed force on the body 12 while simultaneously pivoting the levers 70 and 72 toward one another. The forward force causes the engagement portions 82 to become detached from the surface of fissure 78 with the result that the cams 42 and 44 may now rotate rearwardly on the shaft 40 into the withdrawal position of FIG. 1. Consequently, the engagement portions 82 become disposed between the surfaces 36 and 38 and the chockstone 10 may then be removed by the exertion of rearward force.

The chockstone 10 is immediately ready for use again after it is removed from the fissure 78 by merely releasing the levers 70 and 72 and allowing the springs 50 to rotate the cams 42 and 44 into the insertion position. The chockstone 10 is ready for insertion without the need to manually reconfigure the cams 42 and 44.

While this invention has been described as having a preferred design, it is understood that it is capable of further modifications, uses and/or adaptions of the invention following in general the principle of the invention including such departures from the present disclosure as come within the known or customary practice in the art to which the invention pertains. and as may be applied to the central features hereinbefore set forth, and fall within the scope of the invention of the limits of the appended claims.

What I claim is:

1. A chockstone, comprising:

(a) a frame having a forward end portion and a rearward end portion and said forward end portion including a pair of spaced apart legs and each of said legs having substantially planar upper and lower surfaces;

(b) shaft means connected to and extending from each of said legs;

(c) first and second cam means mounted to said shaft means and adapted for rotating in a common direction about said shaft means between an insertion position and a withdrawal position and each of said cam means including an engagement portion extending outwardly beyond said upper surface when in said insertion position and disposed between said surfaces when in said withdrawal position;

(d) means interconnecting said cam means for permitting each of said cam means to independently rotate between said insertion position and said withdrawal position; and, (e) actuation means associated with said rearward end has a portion thereof operably connected to said interconnecting means for simultaneously rotating said cam means between said insertion position and said withdrawal position.

2. The chockstone as defined in claim 1, wherein:

(a) said legs extend longitudinally and said upper and lower surfaces are disposed in parallel relation.

3. The chockstone as defined in claim 2, wherein:

(a) the upper and lower surface of one of said legs being disposed in parallel relation with the upper and lower surfaces of the other one of said legs.

4. The chockstone as defined in claim 1, wherein:

(a) spring means being associated with each of said cam means for urging said cam means from said withdrawal position to said insertion position.

5. The chockstone as defined in claim 4, wherein:

(a) each of said cam means includes a member extending therefrom for receiving a first end of said spring means; and, (b) each of said legs includes a member extending therefrom for receiving a second end of said spring means.

6. The chockstone as defined in claim 1, wherein:

(a) each of said cam means being disposed adjacent one of said legs; and, (b) said actuation means portion is connected to said cam means at a distance from said shaft for thereby causing said cam means to rotate from said insertion position to said withdrawal position.

7. The chockstone as defined in claim 6, wherein:

(a) an aperture being disposed in said frame extending from generally said rearward end to said forward end;

(b) said aperture being transverse to said shaft and disposed above said shaft; and, (c) at least a portion of said actuation means is slidably received in said aperture whereby rearward sliding of said at least a portion causes said cam means to rotate from said insertion position to said withdrawal position while forward sliding of said at least a portion causes said cam means to rotate from said withdrawal position to said insertion position.

8. The chockstone as defined in claim 7, wherein:

(a) said actuation means includes a rearwardly disposed lever assembly connected to a central shaft slidably disposed in said aperture and said central shaft comprising said at least a portion of said actuation means; and, (b) a forward member is hingedly connected to a forward portion of said central shaft for thereby permitting displacement of said forward member generally transverse to said shaft when said central shaft is slidably displaced in said aperture.

9. The chockstone as defined in claim 8, wherein:

(a) said lever assembly includes first and second lever members hingedly connected to a rearward portion of said central shaft; and, (b) each of said lever members has a cam portion at one end thereof engaged with said frame and a terminal portion spaced therefrom whereby pivoting of said terminal portions away from said frame causes said cam portions to bear against said frame so that said central shaft rearwardly slides in said aperture for thereby rotating said cam means from said insertion position to said withdrawal position.

10. The chockstone as defined in claim 6, wherein said interconnecting means including:

(a) an arcuate slot in each of said cam means; and, (b) pin means being slidably received in each of said slots for thereby permitting each of said cam means to independently rotate from said withdrawal position to said insertion position.

11. The chockstone as defined in claim 10, wherein:

(a) said slots are adjacently disposed and in aligned relation when said cam means are in said insertion position; and, (b) said actuation means portion is disposed between said cam means, and said pin means extend outwardly from opposed sides of said actuation means portion.

12. The chockstone as defined in claim 1, wherein:

(a) each of said cam means has an arcuate peripheral portion and a substantially flat peripheral portion and said substantially flat peripheral portion provides said engagement portion.

13. The chockstone as defined in claim 5, wherein:

(a) each of said cam means includes an outwardly extending arcuate flange portion for protecting said spring means.

14. The chockstone as defined in claim 7, wherein:

(a) an opening disposed in said rearward end portion extends transverse to said aperture and has a portion aligned with said aperture for receiving a connection means therein.

15. A climbing aid, comprising:

(a) a frame having a forward portion with a pair of longitudinally extending aligned spaced legs and rearward portion;

(b) shaft means connected to and extending between said legs;

(c) first and second cam means rotatably mounted to said shaft means and said cam means each including an engagement portion and said cam means rotatable between an insertion position whereby said engagement portions extend beyond an upper surface of said legs and a withdrawal position whereby said engagement portions are disposed below said upper surface;

(d) means interconnecting said cam means for permitting independent rotation of said cam means from said withdrawal position to said insertion position;

(e) spring means associated with each of said cam means for urging said cam means from said withdrawal position to said insertion position; and, (f) actuation means operably connected to said cam means for simultaneously rotating said cam means in a common direction between said insertion position and said withdrawal position.

16. The climbing aid as defined in claim 15, wherein:

(a) said legs disposed in parallel relation and each of said legs includes a botton surface parallel to the upper surface thereof whereby said engagement portion is disposed between said surfaces when in said withdrawal position.

17. The climbing aid as defined in claim 16, wherein said actuation means including:

(a) an aperture disposed in said frame extending between said forward portion and said rearward portion;

(b) a central shaft being disposed in said aperture and adapted for forward and rearward displacement therein;

(c) a forward member having a first end hingedly connected to a forward portion of said central shaft and a second end comprising said interconnection means being connected to said cam means for causing rotation of said cam means upon displacement of said central shaft; and, (d) lever assembly means being connected to a rearward end portion of said central shaft whereby operation of said lever means causes displacement of said central shaft and thereby causing rotation of said cam means.

18. The climbing aid as defined in claim 17, wherein:

(a) an arcuate recess disposed in said rearward portion; and, (b) said lever assembly means includes first and second pivotally interconnected lever member and each of said lever members includes an arcuate portion received in said recess and connected to said rearward end portion.

19. The climbing aid as defined in claim 18, wherein:

(a) each of said lever members includes a cam portion engageable with a portion of said rearward portion and a terminal portion spaced therefrom; and, (b) each of said terminal portions is disposed adjacent one of said legs whereby pivoting of said terminal portions toward each other causes rearward displacement of said central shaft for thereby causing said cam means to rotate between said insertion position and said withdrawal position.

20. The climbing aid as defined in claim 15, wherein:

(a) means associated with said frame permitting connection to a climbing rope.

* * * * *